US009263811B2

(12) United States Patent
Hsu

(10) Patent No.: US 9,263,811 B2
(45) Date of Patent: Feb. 16, 2016

(54) CONNECTOR HAVING A STEP-LIKE SUPPORT PORTION FOR PROVIDING A WICKING SPACE

(71) Applicant: Amphenol East Asia Limited Taiwan Branch (H.K.), Taoyuan County (TW)

(72) Inventor: Wen-Te Hsu, Taoyuan County (TW)

(73) Assignee: AMPHENOL EAST ASIA LIMITED TAIWAN BRANCH (H.K.), Taoyuan County (TW)

( * ) Notice: Subject to any disclaimer, the term of this patent is extended or adjusted under 35 U.S.C. 154(b) by 0 days.

(21) Appl. No.: 14/557,630

(22) Filed: Dec. 2, 2014

(65) Prior Publication Data

US 2015/0200472 A1 Jul. 16, 2015

(30) Foreign Application Priority Data

Jan. 14, 2014 (TW) ..... 103200742 U

(51) Int. Cl.
*H01R 12/62* (2011.01)
*H01R 12/58* (2011.01)
*H01R 12/70* (2011.01)

(52) U.S. Cl.
CPC ..... *H01R 12/58* (2013.01); *H01R 12/62* (2013.01); *H01R 12/707* (2013.01)

(58) Field of Classification Search
CPC ..... H01R 12/58; H01R 12/62
USPC ..... 439/83
See application file for complete search history.

(56) References Cited

U.S. PATENT DOCUMENTS 5,352,125 A * 10/1994 Banakis ..... H01R 4/028 439/78
5,496,180 A * 3/1996 Fabian ..... H01R 4/028 439/60
5,588,885 A * 12/1996 Gotz ..... H01R 4/028 228/39
6,338,634 B1 * 1/2002 Yu ..... H01R 4/028 439/83
6,764,319 B1 * 7/2004 Korsunsky ..... H01R 4/028 439/83
8,241,046 B2 * 8/2012 Takagi ..... H01R 13/6594 439/83
8,696,367 B2 * 4/2014 Daughtry, Jr. ..... H01R 12/57 439/83

* cited by examiner

*Primary Examiner* — Chandrika Prasad
(74) *Attorney, Agent, or Firm* — Bacon & Thomas, PLLC

(57) ABSTRACT

The present invention is to provide a connector having support portions like steps for improving yield rate of soldering, which includes an isolation base provided therein with signal terminals each having two ends respectively exposed out of front and back side surfaces of the isolation base. Support portions each is formed by a protruded part and a recessed part like steps on the back side surface. An end of a positioning terminal can be inserted into a positioning groove on the recessed part and then be exposed out of the back side surface with a length larger than the length of the protruded part that is approximately equal to the length of the signal terminal extended out the back side surface, whereby the end of the positioning terminal can be inserted into a positioning hole on a circuit board when the back side surface is positioned on the circuit board.

5 Claims, 6 Drawing Sheets

CONNECTOR HAVING A STEP-LIKE SUPPORT PORTION FOR PROVIDING A WICKING SPACE

FIELD OF THE INVENTION

The present disclosure generally relates to a connector, more particularly to a connector having support portions like steps for improving the yield rate of soldering.

BACKGROUND OF THE INVENTION

Connectors generally refer to all kinds of connecting components and appurtenances thereof applied for electronic signals and power source, and serve as bridges for all signals. The quality of the connector affects the reliability of current and signal transmission, and is closely related to the operation of an electronic device. General speaking, the connector is usually mounted on a circuit board by soldering. Via the circuit board, the connector transmits data from the outside to a processing unit of the electronic device. However, during the operation of soldering assembly, many errors or problems exist in practice, and it results in real efficiency of the connector not matching with the ideal target. There is a lot of room for improvement in the traditional connector.

Please refer to FIG. 1 which shows a traditional connector 1. The connector 1 includes an outer base 11, an inner base 12 and a plurality of positioning pieces 13. The inner base 12 is fixedly disposed in a center portion of the outer base 11, and provided with a plurality of signal terminals 120. The outer base 11 is provided with support portions 110 protrudingly disposed at four corners thereof, and each of support portions 110 is provided with a positioning groove 111 therethrough. Each of positioning pieces 13 has a structure in fish-spear shape, and the positioning pieces 13 are positioned in the positioning grooves 111, respectively. During assembly for the connector 1, on the circuit board 10, the manufacturer coats solder paste at positions corresponding to the electric contact points (not shown in FIG. 1) and through holes 100, and then positions the outer base 11, the inner base 12 and the positioning pieces 13 which are formed integratedly on the circuit board 10 to. In this case, the connector 1 can be connected on the circuit board 10 by fastening the positioning pieces 13 with fish-spear shape in the through holes 100. Finally, the connector 1 and the circuit board 10 are performed reflow soldering, to enable the solder paste on the circuit board 10 to fix the signal terminals 120 and the positioning pieces 13, so as to complete the assembly.

The connector 1 can be firmly mounted on the circuit board 10 via the positioning pieces 13 and the solder paste by manners of fastening and soldering, but a problem which is hard to be prevented exists in practical implementation. During the reflow soldering operation, a part of the solder paste will be risen along the positioning pieces 13, and it results in the wicking effect. When the wicking effect occurs, the strength of soldering is reduced and the solder paste will be pushed to the support portion 110 of the outer base, it will cause parts lift. The serious case will generate solder balls and cause problems of bad yield rate of the connector 1, insufficient stability of signal transmission, and short circuit, etc.

Therefore, what is need is to improve the structure of the connector for preventing the mounting position of the connector from being affecting by the wicking of the solder paste during reflow soldering operation, and the yield rate of soldering and quality of the connector can be further improved.

SUMMARY OF THE INVENTION

In view of the problems of the yield rate of traditional connector being easily impaired due to the wicking, the inventor bases many years research knowledge and industry experience, and performs test improvement for many times, to design a connector having support portions like steps to improve the yield rate of soldering and solve the problems of assembly and soldering in the traditional connector.

Objective of the present disclosure is to provide a connector having support portions like steps for improving the yield rate of soldering. The connector is mounted on a circuit board of an electronic device, the circuit board is provided with a plurality of electric contact points and a plurality of positioning holes. The connector includes an isolation base and a plurality of positioning terminals, the isolation base is provided with a plurality of signal terminals mounted at a center portion thereof. An end of each of the plurality of signal terminals is exposed out of a front side surface of the connector, and other end of each of the plurality of signal terminals is extended out of a back side surface of the isolation base. The isolation base is further provided with a plurality of support portions on the back side surface thereof and near a periphery of the back side surface. Each of the plurality of support portions is formed by a protruded part and a recessed part, the protruded part is linked with the recessed part to form the support portion like steps, and a wicking space is formed between the protruded part and the recessed part. Each of the recessed parts is provided with a positioning groove passed therethrough, and the length of the protruded part is approximately equal to a length of a portion of the other end of each of the plurality of signal terminals extended out the isolation base. Each of the plurality of positioning terminals having a structure matching with each of positioning grooves, so the plurality of positioning terminals can be fixed in the plurality of positioning groove, and an end of each of the positioning terminals can be inserted into the positioning groove to be exposed out of the back side surface of the isolation base, an exposed length of the end of the positioning terminal is larger than the protruded length of the protruded part, whereby the ends of the plurality of positioning terminals can be inserted into the plurality of positioning holes on the circuit board when the back side surface of the isolation base is positioned on the circuit board. In this case, the other ends of the plurality of signal terminals are electrically are connected with the electric contact points, and the protruded parts are abutted against the circuit board. Therefore, the plurality of signal terminals and positioning terminals can be firmly soldered on the circuit board by the solder paste coated on the circuit board, and the problem of the solder paste being pushed to the isolation base due to the wicking effect can be solved, and the yield rate of the connector can be ensured.

BRIEF DESCRIPTION OF THE DRAWINGS

The detailed structure, operating principle and effects of the present disclosure will now be described in more details hereinafter with reference to the accompanying drawings that show various embodiments of the present disclosure as follows.

DETAILED DESCRIPTION OF THE PREFERRED EMBODIMENTS

Figure 1:
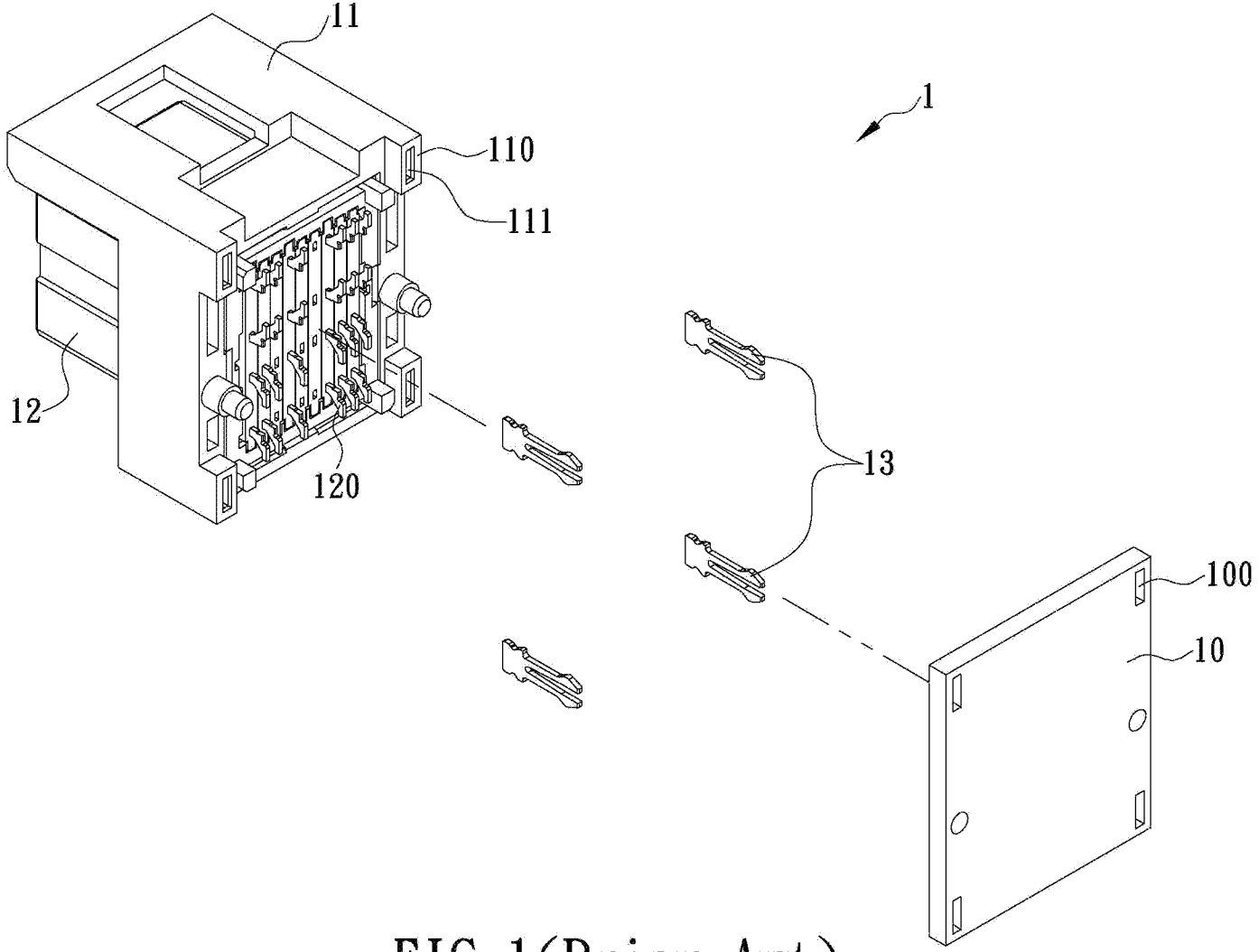
FIG. 1(Prior Art)
FIG. 1 is a schematic view of a traditional connector.

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or" includes any and all combinations of one or more of the associated listed items.

The present disclosure provides a connector having support portions like steps for improving yield rate of soldering. Please refer to FIG. 2 which is a first preferred embodiment of the present disclosure. The connector 2 is mounted on a circuit board P of an electronic device. The circuit board P is provided with a plurality of electric contact points and a plurality of positioning holes P1. The connector 2 includes an inner base 21, an isolation base 22 and a plurality of positioning terminals 23. The inner base 21 is embedded with a plurality of signal terminals 211, and an end of each of the plurality of signal terminals 211 is exposed out of the front side surface of the inner base 21 (for easily illustrating the structural feature, the lower right corner of the FIG. 2 is defined as the back, and the top left corner is the front), and other end of each of the plurality of signal terminals 211 is exposed out of the back side surface of the inner base 21.

Figure 2:
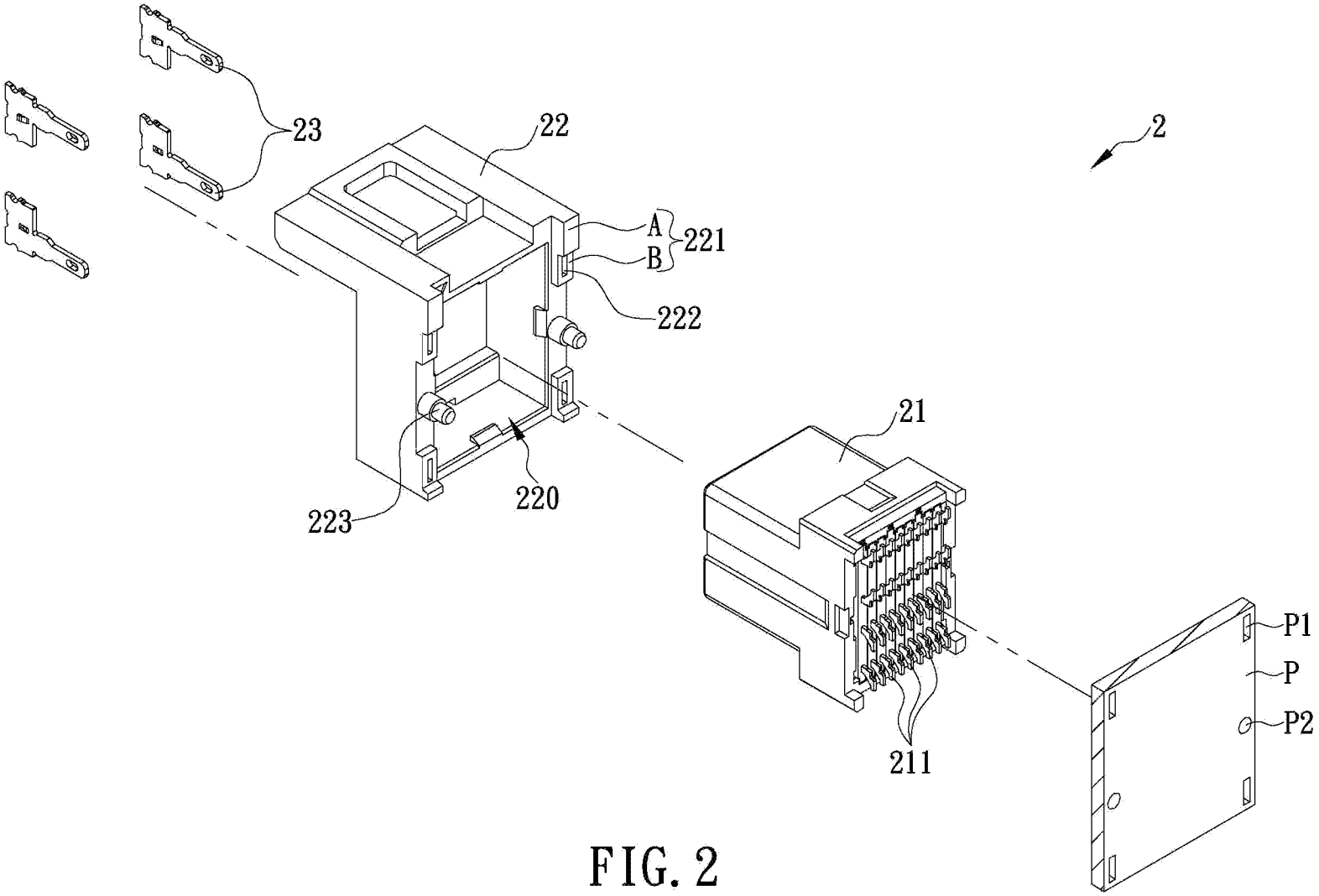
FIG. 2 is a schematic view of a first preferred embodiment of a connector of the present disclosure.
Figure 3:
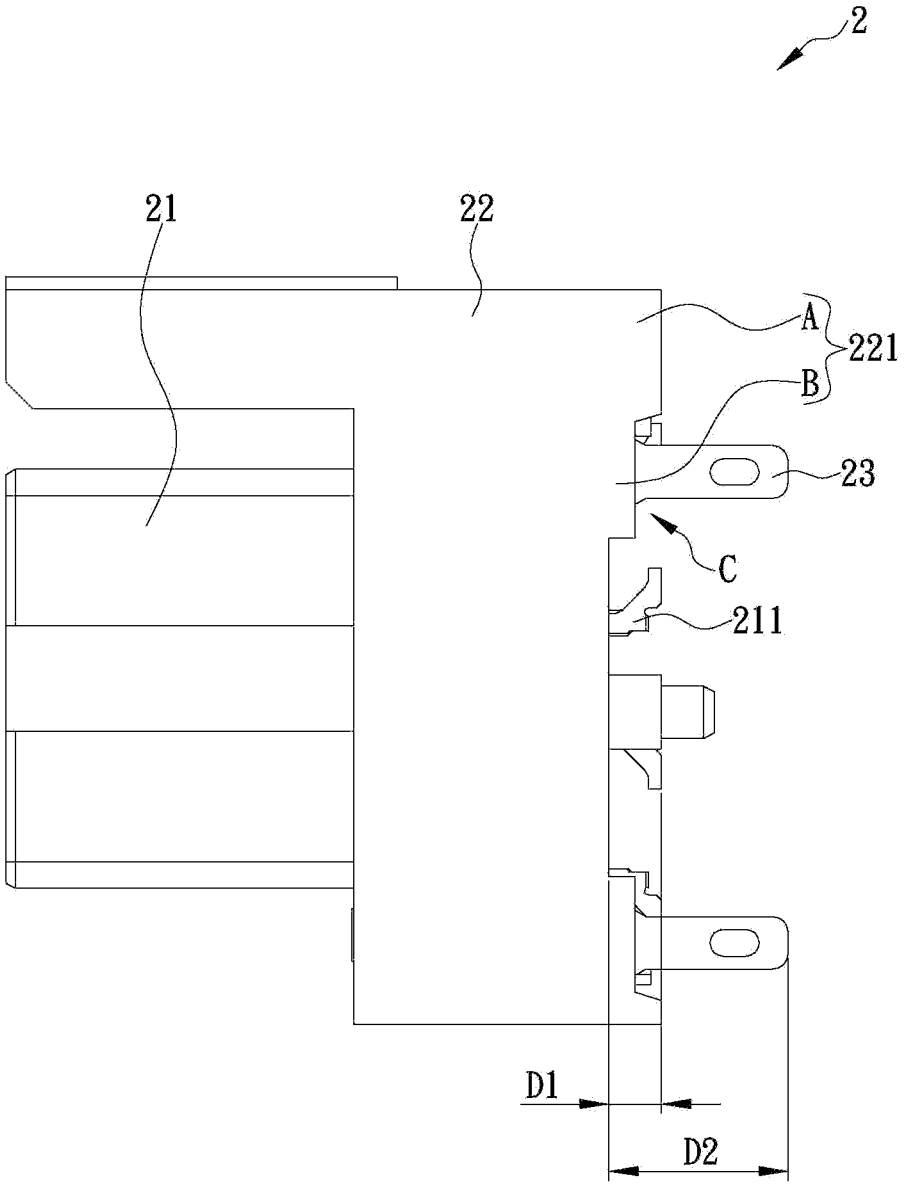
FIG. 3 is a lateral view of the first preferred embodiment of the connector of the present disclosure.

Please refer to FIG. 2 and FIG. 3, the isolation base 22 is provided with an assembly opening 220 disposed at a center portion thereof and passed through the isolation base 22. A structure of the assembly opening 220 matches with the inner base 21, so that the inner base 21 can be positioned in the assembly opening 220, and other ends of the plurality of signal terminals 211 can be extended out of the back side surface of the isolation base 22. The isolation base 22 is provided with a plurality of support portions 221 disposed on the back side surface thereof and near a periphery of the isolation base 22, each of the plurality of support portions 221 is formed by a protruded part A and a recessed part B, the protruded part A and the recessed part B are linked with each other to form the structures of the support portions 221 like steps. A wicking space C is formed between the protruded part A and the recessed part B, and each of the recessed parts B is provided with a positioning groove 222 passed therethrough. The protruded length of the protruded part A is approximately equal to a length of a portion of other end of each of the plurality of signal terminals 211 extended out of the isolation base 22, and they both are the first extension length D1 (as shown in FIG. 3).

A structure of each of the plurality of positioning terminals 23 matches with that of each of the plurality of positioning grooves 222, so the plurality of positioning terminals can be inserted into the positioning grooves 222 via the front side surface of the isolation base 22, and ends of the plurality of positioning terminals 23 can be passed through the positioning grooves 222 and exposed out of the back side surface of the isolation base 22. A second extension length D2 of the end of the positioning terminal 23 exposed out of the isolation base 22 is larger than the first extension length D1 of the protruded part A, so the ends of the plurality of positioning terminals 23 can be inserted into the plurality of positioning holes P1 when the back side surface of the isolation base 22 is positioned on the circuit board P. Meanwhile, the other ends of the plurality of signal terminals 211 are electrically connected with the plurality of electric contact points, and the plurality of protruded parts A are abutted on the circuit board P, whereby the plurality of signal terminals 211 and positioning terminals 23 can be firmly soldered on the circuit board P by the solder paste coated on the circuit board P.

Therefore, during the process of positioning the connector 2 on the circuit board P and then inputting the circuit board P into a reflow oven for reflow soldering, the plurality of wicking spaces C are formed on the isolation base 22, so the solder paste still can be located on portions of the plurality of positioning terminals 23 corresponding to the wicking spaces C and not directly pushed to the back side surface of the isolation base 22 even if the solder paste occurs the wicking due to heating. Therefore, an assembly precision between the isolation base 22 and the circuit board P can be ensured efficiently, and the yield rate of the connector 2 is further ensured.

In addition, the wicking spaces C formed by the support portions 221 like steps, can be used as spaces for heat convection, so the hot wind of the reflow oven can be applied on the plurality of signal terminals 211 well, to improve the efficiency of reflow soldering. In this exemplary embodiment, in order to improve the robustness and position precision of the connector 2, the isolation base 22 can be provided with a plurality of protruded pillars 223 at the back side surface thereof, and the circuit board P has a plurality of through holes P2 located at the positions corresponding to the plurality of protruded pillars 223, respectively. The plurality of protruded pillars can provide assistant support force and positioning function while the connector 2 is mounted on the circuit board P.

Figure 4:
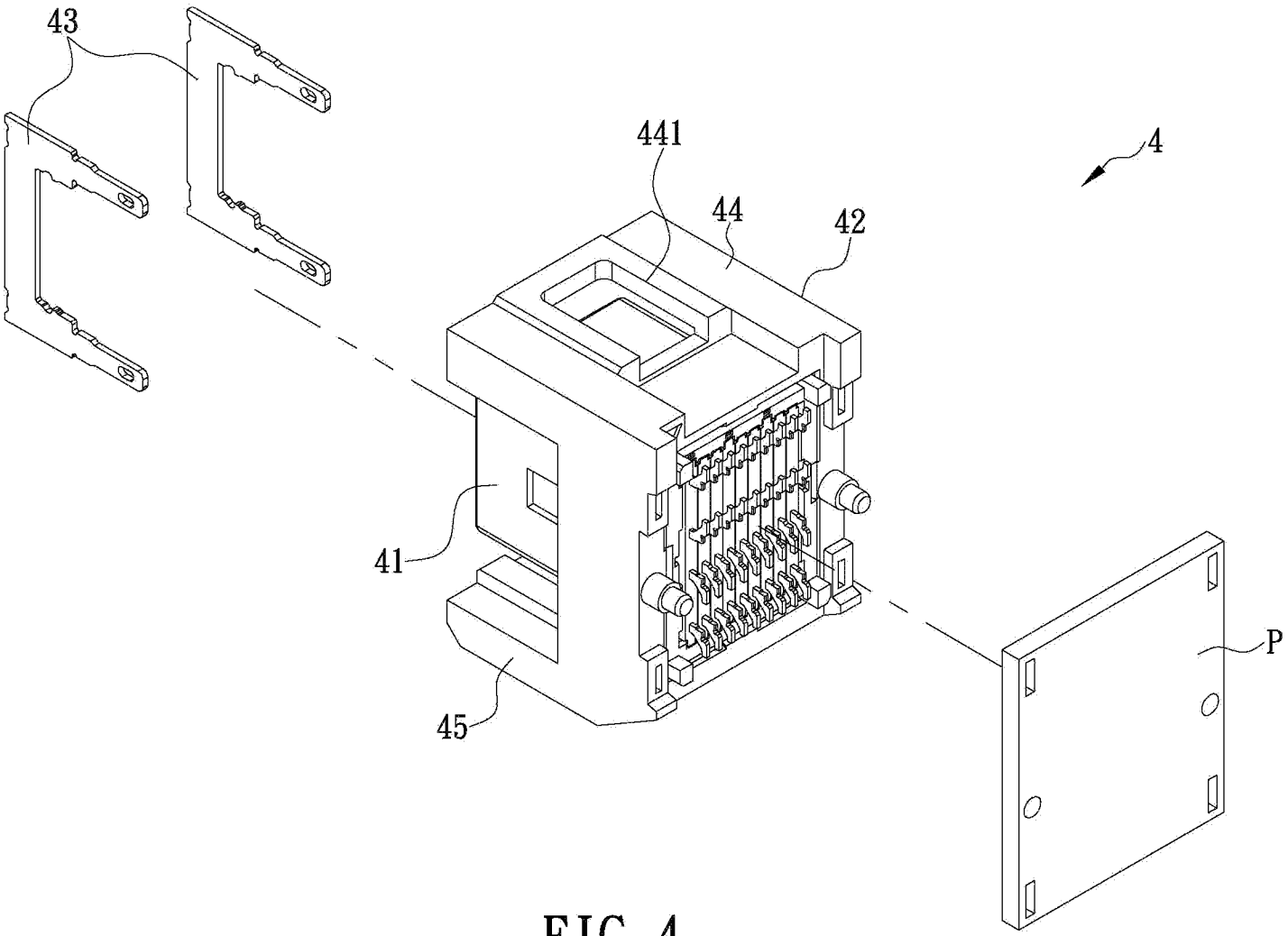
FIG. 4 is a schematic view of a second preferred embodiment of the connector of the present disclosure.
Figure 5:
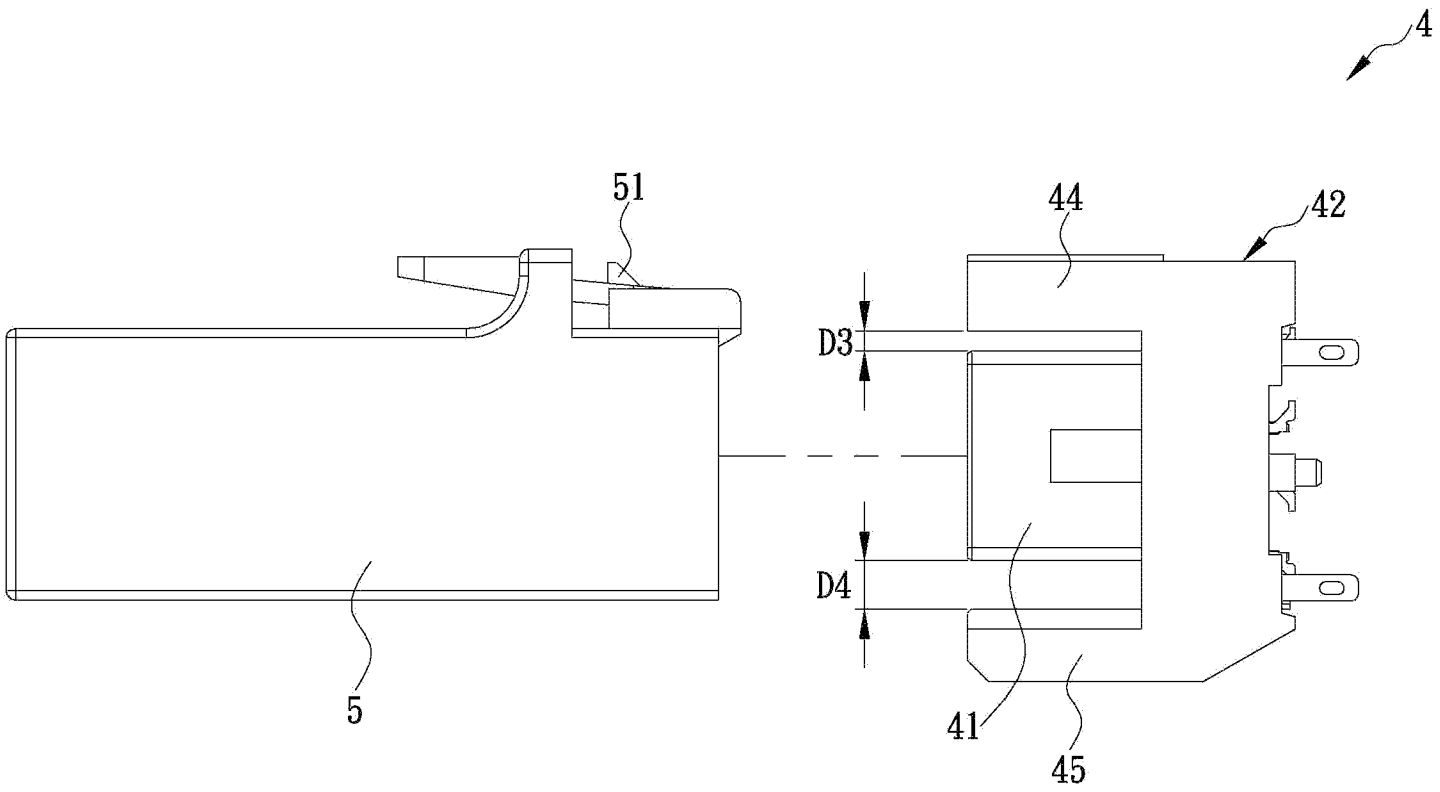
FIG. 5 is a lateral view of the second preferred embodiment of the connector of the present disclosure.

Please refer to FIG. 4 and FIG. 5 which show a second preferred embodiment of the present disclosure. In the implementation, the connector 4 also includes an inner base 41, an isolation base 42 and a plurality of positioning terminals 43. The two ends of the front side surface of the isolation base 42 are extended frontward to form a connecting wall 44 and a stop wall 45, the connecting wall 44 is provided with a fastening opening 441 located at a position corresponding to the front section of the inner base 41. When the external connector 5 and the connector 4 are plugged together, a fastening part 51 of the external connector 5 can be fastened in fastening opening 441, to enable the connector 4 and the external connector 5 to be connected integratedly. Please refer to FIG. 5. A first spacing distance D3 is kept between the connecting wall 44 and the inner base 41, a second spacing distance D4 is kept between the stop wall 45 and the inner base 41, the spacing distances D3 and D4 are different (in this exemplary embodiment, the first spacing distance D3 is smaller than the second spacing distance D4). Therefore, if the user inserts the external connector 5 into the connector 4 in wrong direction (such as upside down), the external connector 5 will be abutted against the connecting wall 44 or the stop wall 45 firstly and hard to be inserted between the connecting wall 44 and the stop wall 45 well. Accordingly, a simple and effective mistake-proofing scheme can be provided.

Figure 6:
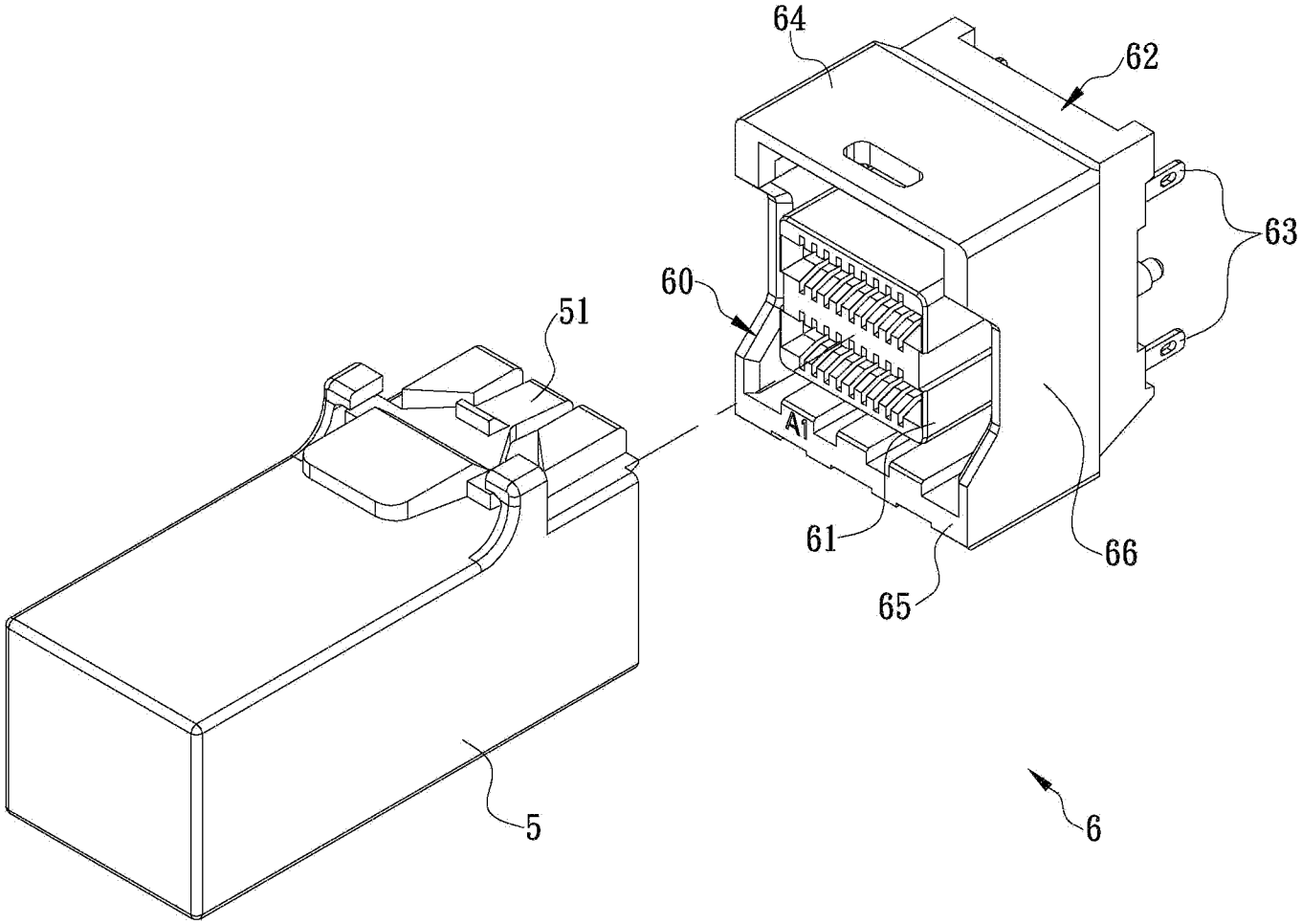
FIG. 6 is a schematic view of a third preferred embodiment of the connector of the present disclosure.

Please refer to FIG. 6 which shows a third preferred embodiment of the present disclosure. In the embodiment, the connector 6 also includes an inner base 61, an isolation base 62 and a plurality of positioning terminals 63. A right end and left end of the connecting wall 64 on the isolation base 62 can be linked with each other via a surrounding wall 66 and the stop wall 65, whereby a plug groove 60 can formed in a space surrounded by the connecting wall 64, the surrounding wall 66 and the stop wall 65, and the front section of the inner base 61 can be kept locating in the plug groove 60. Accordingly, the structural strength of the isolation base 62 can be further improved to prevent the isolation base 62 from being broken by a too large insertion-withdrawal force applied by the user.

Please refer to FIG. 2 through FIG. 6. In the above-mentioned embodiments, the structures of rear ends of the plurality of positioning terminals 23, 43 and 63 are straight shape so the plurality of positioning terminals 23, 43 and 63 can be inserted into the plurality of positioning holes P1 even if a machine of the manufacturer is not equipped with packing function. However, the structure of the plurality of positioning terminals 23, 43 and 63 can also be designed as a fish-spear shape as shown in FIG. 1. In addition, as shown in FIG. 4, the structures of the plurality of positioning terminals 43 can be formed by connecting pairs of the plurality of positioning terminals 43 as "U" type, so as to improve convenience of assembly, and further reinforce the positioning robustness of the isolation base 42.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A connector having a support portions like steps for improving yield rate of soldering, mounted on a circuit board of an electronic device, the circuit board provided with a plurality of electric contact point and a plurality of positioning holes, the connector comprising:

an isolation base, provided with a plurality of signal terminals mounted at a center portion thereof, an end of each of the plurality of signal terminals exposed out of a front side surface of the isolation base and other end of each of signal terminals extended out of the back side surface of the isolation base, and the isolation base provided with a plurality of support portions on a back side surface thereof and near a periphery of the back side surface, each of the plurality of support portions formed by a protruded part and a recessed part, the protruded part linked with the recessed part to form the support portion like steps, a wicking space formed between the protruded part and the recessed part, each of recessed parts provided with a positioning groove passed therethrough, the length of the protruded part equal to a length of portion of the other end of each of the plurality of signal terminals extended out the isolation base; and a plurality of positioning terminals, each of the plurality of positioning terminals having a structure matching with each of positioning grooves to be fixed in the positioning groove, and an end of each of the positioning terminals inserted into the positioning groove to be exposed out of the back side surface of the isolation base, a length of an exposed portion of the end of the positioning terminal larger than the length of the protruded part;

whereby, when the back side surface of the connector is positioned on the circuit board, the ends of the plurality of positioning terminals are inserted into the positioning holes on the circuit board, the other ends of the signal terminals are electrically connected with the electric contact points on the circuit board, and the protruded parts are abutted against the circuit board.

2. The connector as defined in claim 1, wherein the isolation base has an assembly opening passed through the center portion thereof, and the connector further comprises an inner base which is embedded with the plurality of signal terminals, and the inner base has a structure matching with the assembly opening and can be embedded in the assembly opening, whereby other ends of the plurality of signal terminals can be extended out of the back side surface of the isolation base.

3. The connector as defined in claim 2, wherein two ends of the front side surface of the connector are extended outwardly to form a connecting wall and a stop wall respectively, and the connecting wall is provided with a fastening opening corresponding to the inner base, and the fastening opening can be fastened with a fastening part of an external connector, a first spacing distance is kept between the connecting wall and the inner base, a second spacing distance is kept between the stop wall and the inner base, and the first spacing distance is not equal to the second spacing distance.

4. The connector as defined in claim 3, wherein two ends of the connecting wall are connected with each other via a surrounding wall and the stop wall, whereby a plug groove is formed in a space surrounded by the connecting wall, the surrounding wall and the stop wall, and the front section of the inner base is positioned in the plug groove.

5. The connector according to claim 4, wherein the isolation base has a plurality of protruded pillar protrudingly disposed on the back side surface of the isolation base, and the circuit board has through holes located on positions corresponding to the protruded pillars respectively, whereby the protruded pillars can be embedded into the through holes when the back side surface of the connector is positioned on the circuit board.

* * * * *